US007967225B1

(12) United States Patent
Schulz

(10) Patent No.: US 7,967,225 B1
(45) Date of Patent: Jun. 28, 2011

(54) GARBAGE DISPOSAL BLADE GUARD

(76) Inventor: Victor Schulz, Waite Park, MN (US)

( * ) Notice: Subject to any disclaimer, the term of this patent is extended or adjusted under 35 U.S.C. 154(b) by 0 days.

(21) Appl. No.: 12/965,867

(22) Filed: Dec. 11, 2010

Related U.S. Application Data

(60) Provisional application No. 61/295,709, filed on Jan. 16, 2010.

(51) Int. Cl.
*B02C 23/36* (2006.01)

(52) U.S. Cl. ..... 241/46.013; 241/46.015; 241/46.016; 4/DIG. 4

(58) Field of Classification Search ..... 241/46.013–46.016; 4/DIG. 4, 4/255.11, 286
See application file for complete search history.

(56) References Cited

U.S. PATENT DOCUMENTS

| | | | |
|---|---|---|---|
| D54,617 | S | 3/1920 | Haven |
| D92,115 | S | 2/1934 | Spencer |
| D92,433 | S | 6/1934 | Spencer |
| D103,769 | S | 3/1937 | Spencer |
| 2,236,885 | A | 4/1941 | Zinkil et al. |
| 2,244,402 | A | 6/1941 | Powers |
| 2,544,498 | A | 3/1951 | Hiertz |
| 2,670,143 | A | 2/1954 | Jordan |
| 2,793,373 | A | 5/1957 | Ewing |
| 2,846,154 | A | 8/1958 | Wieczorek |
| 2,875,958 | A | 3/1959 | Wieczorek |
| 2,896,866 | A | 7/1959 | Hyde |
| 2,925,225 | A | 2/1960 | Jordan |
| 2,948,482 | A | 8/1960 | Jordan |
| 2,953,308 | A | 9/1960 | Isola |
| 2,980,351 | A | 4/1961 | Greene |
| D194,506 | S | 2/1963 | Laan |
| 3,161,360 | A | 12/1964 | Levine |
| 3,449,775 | A | 6/1969 | De Krauze |
| 3,702,013 | A | 11/1972 | Gebert |
| 3,742,524 | A | 7/1973 | Ballentine |
| 3,742,525 | A | 7/1973 | Oropallo |
| 3,745,594 | A | 7/1973 | Cosper |
| 3,788,485 | A | 1/1974 | Bruning |

(Continued)

FOREIGN PATENT DOCUMENTS

EP 1509658 A1 3/2005

(Continued)

OTHER PUBLICATIONS

"General Requirements for All Machines", OSHA Regulations, 29 CFR 1910.212, 1 page.

*Primary Examiner* — Bena Miller
(74) *Attorney, Agent, or Firm* — Albert W. Watkins

(57) ABSTRACT

An inlet to an under-sink garbage disposal is guarded by a novel guard and splash-back baffle that comprises an outer tubular ring defining an exterior circumference approximately sized to coincide with an inside diameter of the plumbing inlet; an inner tubular ring coupled through at least one radially extending bar with the outer ring and defining an open and unobstructed inner circumference. The splash baffle comprises a resilient body affixed adjacent to the garbage disposal blade guard that extends generally across the plumbing inlet to constrict flow therethrough. The guard is divided into a plurality of resilient flaps, and is operative in combination with the garbage disposal blade guard to define a flexible one-way valve permitting matter to pass into a garbage disposal while substantially blocking matter from being ejected from the garbage disposal through the garbage disposal blade guard.

15 Claims, 4 Drawing Sheets

U.S. PATENT DOCUMENTS

| | | | |
|---|---|---|---|
| 3,854,151 | A | 12/1974 | Boudewyn |
| 3,982,289 | A | 9/1976 | Robbins |
| 4,138,747 | A | 2/1979 | Zijlstra |
| 4,161,043 | A | 7/1979 | Flores |
| 4,164,796 | A | 8/1979 | Sakow |
| 4,321,713 | A | 3/1982 | Thompson |
| 4,329,744 | A | 5/1982 | Cuschera |
| 4,443,897 | A | 4/1984 | Austin |
| D278,459 | S | 4/1985 | Cook |
| 4,519,102 | A | 5/1985 | Efstratis |
| D290,679 | S | 7/1987 | Thorpe |
| 4,752,035 | A | 6/1988 | Felder |
| 4,883,590 | A | 11/1989 | Papp |
| 4,910,811 | A | 3/1990 | Izzi, Sr. |
| 5,271,108 | A | 12/1993 | Wicke |
| D370,716 | S | 6/1996 | Menzies |
| 6,000,643 | A | 12/1999 | Gelder |
| D461,233 | S | 8/2002 | Whalen |
| 6,735,791 | B1 | 5/2004 | Lordahl et al. |
| 7,264,188 | B2 | 9/2007 | Anderson et al. |
| 7,533,836 | B2 | 5/2009 | Pan |
| 7,740,197 | B1 | 6/2010 | Schulz |
| 2010/0132102 | A1 * | 6/2010 | Flamand ..... 4/255.11 |

FOREIGN PATENT DOCUMENTS

| | | | |
|---|---|---|---|
| WO | WO 03/093592 | A1 | 11/2003 |
| WO | WO 2009/116736 | A2 | 9/2009 |

* cited by examiner

GARBAGE DISPOSAL BLADE GUARD

CROSS REFERENCE TO RELATED APPLICATIONS

This application claims the benefit of U.S. Provisional Patent Application No. 61/295,709 filed on Jan. 16, 2010, of the same inventorship and entitled "Garbage Disposal Guard", the contents which are incorporated herein by reference in entirety.

BACKGROUND OF THE INVENTION

1. Field of the Invention

This invention pertains generally to the field of solid material comminution or disintegration, and more particularly to inlet provisions for under-sink garbage disposals. In a preferred embodiment, an inlet to an under-sink garbage disposal is guarded by a novel guard and splash-back baffle that permits large waste to pass through, while preventing accidental passage of utensils and other undesirable objects. Further, the combination guard and splash-back baffle co-operatively protect an operator from both harm and splash-back.

2. Description of the Related Art

Persons working in a kitchen generate large amounts of food scraps during the preparation of food. These scraps can range in size from relatively large waste, such as a rotten potato or tomato down to very small trimmings or cuttings that are stuck to a utensil or cutting board. Likewise, those persons consuming the food often leave behind more or less food as waste. Since this food waste will decompose quickly and harmlessly in waste treatment systems, including both municipal and septic systems, the food may be effortlessly disposed of by sending it directly out a sink drain. This permits a cook or cleaner to simply rinse the dishes, utensils and the like, and run the food waste down the drain. However, larger waste such as a whole potato would undesirably clog the plumbing. In fact, even mid-sized food waste can be caught in a partial clog in the plumbing with adverse consequence.

To avoid clogging the plumbing, artisans have developed garbage disposals that comminute or grind food waste into small particles that will pass safely through plumbing. A conventional garbage disposal includes an inlet connected to the sink drain, a grinder, and a motor. The inlet is generally fitted with a rubber splash baffle that has a small center opening and is generally slit radially into sections resembling pie slices. A number of United States patents illustrate these prior art splash baffles, the contents and teachings of each which are incorporated herein by reference, including 2,793,373 by Ewing, entitled "Baffle and closure assembly for food waste disposer"; 2,846,154 by Wieczorek, entitled "Sink mount for waste disposal units"; 2,875,958 by Wieczorek, entitled "Baffle and stopper for waste disposal unit"; 2,896,866 by Hyde, entitled "Baffle and stopper for waste disposal unit"; 2,925,225 by Jordan, entitled "Cushioned hanging device for garbage grinders"; 2,948,482 by Jordan, entitled "Splash guard with plug for waste disposal apparatus"; 2,980,351 by Greene, entitled "Waste disposer and splash guard therefor"; and 6,735,791 by Lordahl et al, entitled "Disposal adapter". The splash baffle provides nominal resilience or resistance in either direction, thereby deforming to permit flow down into the garbage disposal, but when there is insufficient flow, the water will pass around and not deform the rubber. Since during low flow the rubber splash baffle is not deformed, low-mass water and food that is kicked up toward the operator will hit the rubber and not pass back up.

Unfortunately, the splash baffle must be very pliant to permit food and low volumes of water to pass through. This means that more forceful back-splashes will still deform the rubber upwardly, causing the operator to be unpleasantly splashed. Furthermore, since there is no guard or screen, utensils may pass down into the sink. When a hard object such as a spoon engages with the disposal blades, the utensil may be thrown forcefully from the sink, or the utensil may block and seize the disposal.

The splash baffle also provides no protection against a person inserting their hand into the disposal inlet, particularly when the disposal has seized from engagement with a spoon or other hard object. Yet, as may be appreciated, it is a natural first response for a person to reach in and try to remove the utensil. A typical household garbage disposal has a motor that is more powerful than most all blenders, and so, even if the person successfully dislodges the utensil, the motor may force the utensil as soon as the utensil is loosened sufficiently, which can cause great harm to the person. Further, when a person is working on food preparation, it is very easy for them to rush and push material into the disposal, or for a myriad of other reasons accidentally endanger themselves.

Typically, one thinks of garbage disposals for home use, but disposals are extensively used throughout the commercial food industry, where great quantities of food must be disposed of quickly. Examples of food industries range from school and restaurant kitchens to food preparation businesses, such as frozen or non-frozen food manufacturers, butcher shops, and even meat packers where unusable portions of the meat must be disposed. The throat of a home garbage disposal is of a size that allows the insertion of an adult hand. In retail and industrial food preparation establishments, garbage disposal capacity is even larger than those used in the home. Consequently, the garbage disposal throat is larger than that for home use, making the danger of hand insertion even greater. Garbage disposals in school and commercial kitchens are also potentially more powerful, so that they may quickly and efficiently grind up anything coming in to contact with the grinding or cutting heads. The garbage disposals represent a clear and present danger to kitchen staff. Consequently, a guard is necessary to protect kitchen staff from accidental injury or harm caused by accidental contact with the garbage disposal blades, or contact with matter expelled therefrom. As a result of the risk, in a commercial setting Occupational Safety and Health Administration (OSHA) regulations mandate that the garbage disposal entrance be protected. The regulations further require that the guard not be user-removable, so that it cannot easily be tampered with.

My prior U.S. Pat. No. 7,740,197, entitled "Garbage disposal guard", the teachings and contents which are incorporated herein by reference, illustrates one exemplary guard which is designed to meet the OSHA regulations in combination with a garbage disposal unit. While this guard performs the intended functions in an exemplary manner, several opportunities exist for improvement. A first opportunity has to do with splash-back. The rubber splash baffle found in some disposal units is only of limited effectiveness, as has been outlined herein above. Further, since the guard in commercial units by OSHA regulations is not operator-removable, the guard acts as a limit to the ultimate size of food that may be passed therethrough. A finer grating will prevent hands and utensils from passing through, but will also prevent larger food waste from passing, including the rotten potato or tomato mentioned herein above.

A number of other artisans have designed drain guards, including features specifically for garbage disposal. The following U.S. patents, the contents and teachings which are incorporated herein by reference, are exemplary of these: 2,244,402 by Powers, entitled "Waste disposal apparatus"; 2,544,498 by Hiertz, entitled "Removable strainer-stopper assembly for sinks or the like"; 2,670,143 by Jordan, entitled "Garbage disposer with protective inlet"; 2,953,308 by Isola, entitled "Domestic appliance"; 3,161,360 by Levine, entitled "Guard for garbage disposal"; 4,519,102 by Efstratis, entitled "Garbage disposal guard"; 4,752,035 by Felder, entitled "Disposal guard"; 5,271,108 by Wicke, entitled "Sink drain guard"; 6,000,643 by Gelder, entitled "Safety entrance for garbage grinder"; 7,264,188 by Anderson et al, entitled "Noise baffle for food waste disposer"; and 7,533,836 by Pan, entitled "Splash guard for a garbage disposal unit".

Additional patents and published applications that illustrate various sink and drain strainers, the contents and teachings which are incorporated herein by reference, include: 2,236,885 by Zinkil et al, entitled "Sink strainer and stopper and the like"; 3,449,775 by De Krauze, entitled "Kitchen sink plug"; 3,702,013 by Gebert, entitled "Hair Catching Device"; 3,742,524 by Ballentine, entitled "Hair Strainer: Drain Strainer"; 3,742,525 by Oropallo, entitled "Drain Fitting"; 3,745,594 by Cosper, entitled "Shower Floor Drain"; 3,788,485 by Bruning, entitled "Drain Guard for Contact Lens"; 3,854,151 by Boudewyn, entitled "Floor Drain"; 3,982,289 by Robbins, entitled "Disposable sink strainer"; 4,138,747 by Zijlstra, entitled "Drainage fittings and/or wash-house fittings"; 4,161,043 by Flores, entitled "Sealing mechanism for a liquid floor drain"; 4,164,796 by Sakow, entitled "Sink strainer assembly"; 4,321,713 by Thompson, entitled "Large capacity drainage receptacle"; 4,329,744 by Cuschera, entitled "Shower receptor drain"; 4,443,897 by Austin, entitled "Anti-clog sink device"; 4,883,590 by Papp, entitled "Adjustable floor drain apparatus"; 4,910,811 by Izzi, Sr., entitled "Plastic floor drain"; Des 278,459by Cook, entitled "Sink strainer"; Des 370,716by Menzies, entitled "Deck drain"; Des 461,233by Whalen, entitled "Marine deck drain strainer"; WO 03/093592 by Stephenson et al, entitled "Pipe filter and closure assembly"; EP 1,509,658 by Stephenson et al, entitled "Pipe filter and closure assembly"; and WO 2009/116736 by Lee, entitled "Foreign substance filtering film for drain and method for manufacturing same".

Other patents and published applications of no relevance to patentability but that illustrate various concepts for which the contents and teachings which are incorporated herein by reference, include: Des 54,617by Haven, entitled "Gutter screen"; Des 92,115by Spencer, entitled "Flower holder"; Des 92,433by Spencer, entitled "Flower holder"; Des 103,769by Spencer, entitled "Flower holder"; Des 194,506by Laan, entitled "Flower pot"; and Des 290,679by Thorpe, entitled "Drain pan".

In addition to the foregoing documents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is, in combination, a garbage disposal blade guard and splash baffle for guarding a garbage disposal adjacent a plumbing inlet thereof from accidental and harmful interaction. The garbage disposal blade guard comprises an outer ring defining an exterior circumference approximately sized to coincide with an inside diameter of the plumbing inlet; an inner ring defining an open and unobstructed inner circumference; and radial bars extending between the inner and outer rings. The splash baffle comprises an elastomeric sheet affixed adjacent to the garbage disposal blade guard, and has slits radiating from a center of the elastomeric sheet that divide the elastomeric sheet into a plurality of resilient flaps. The splash baffle is operative in combination with the garbage disposal blade guard to define a flexible one-way valve permitting matter to pass into a garbage disposal while substantially blocking matter from being ejected by the garbage disposal through the garbage disposal blade guard.

In a second manifestation, the invention is, in combination, a garbage disposal blade guard and splash baffle for guarding a garbage disposal adjacent a plumbing inlet thereof from accidental and harmful interaction. The garbage disposal blade guard comprises an outer ring defining an exterior circumference approximately sized to coincide with an inside diameter of the plumbing inlet; and an inner ring coupled with the outer ring and defining an open and unobstructed inner circumference. The splash baffle comprises a resilient body affixed adjacent to the garbage disposal blade guard that extends generally across the plumbing inlet to constrict flow therethrough. The guard is divided into a plurality of resilient flaps, and is operative in combination with the garbage disposal blade guard to define a flexible one-way valve permitting matter to pass into a garbage disposal while substantially blocking matter from being ejected from the garbage disposal through the garbage disposal blade guard.

In a third manifestation, the invention is a garbage disposal blade guard, for guarding a garbage disposal adjacent a plumbing inlet thereof from accidental and harmful interaction. The blade guard comprises an outer ring defining an exterior circumference approximately sized to coincide with an inside diameter of the plumbing inlet; an inner ring defining an open and unobstructed inner circumference; and radial bars extending between the inner ring and said outer ring.

OBJECTS OF THE INVENTION

Exemplary embodiments of the present invention solve inadequacies of the prior art by providing a novel guard and splash-back baffle to an inlet of an under-sink garbage disposal, where the splash back guard is placed immediately adjacent to and cooperative with the garbage disposal blade guard.

A first object of the invention is to guard an inlet of an under-sink garbage disposal against accidental passage of utensils and other undesirable objects. A second object of the invention is to permit large waste to pass through and provide minimal obstruction to waste disposal. Another object of the present invention is to protect an operator from both harm and splash-back. A further object of the invention is to provide a guard which is readily fabricated using optimal materials and techniques. Yet another object of the present invention is to comply fully with OSHA requirements.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
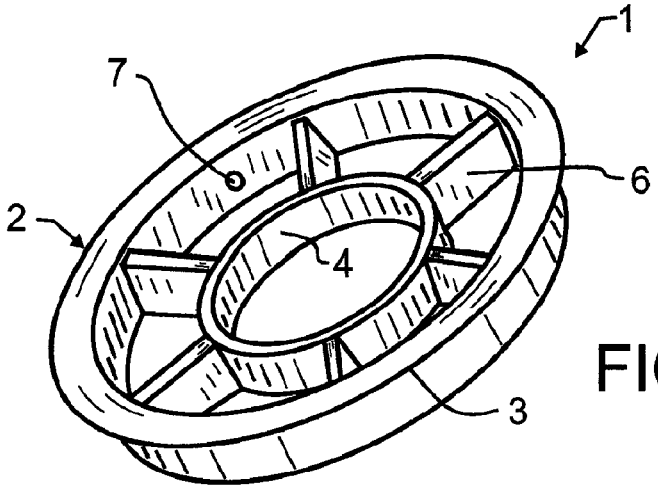
FIG. 1 illustrates a preferred embodiment garbage disposal blade guard designed in accord with the teachings of the present invention from a projected view.
Figure 2:
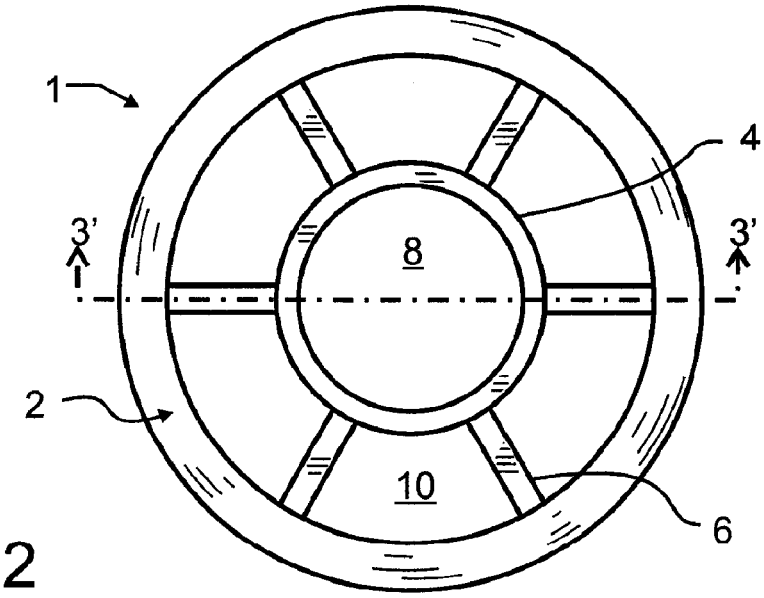
FIG. 2 illustrates the preferred embodiment garbage disposal blade guard of FIG. 1 from a top plan view.
Figure 3:
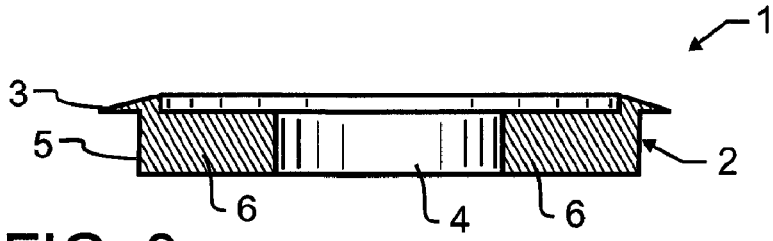
FIG. 3 illustrates the preferred embodiment garbage disposal blade guard from sectional view taken along line 3' of FIG. 2.
Figure 4:
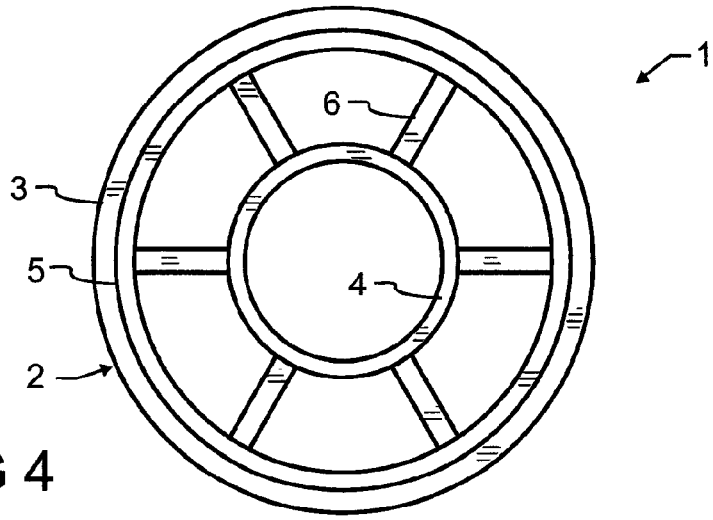
FIG. 4 illustrates the preferred embodiment garbage disposal blade guard of FIG. 1 from a bottom plan view.
Figure 5:
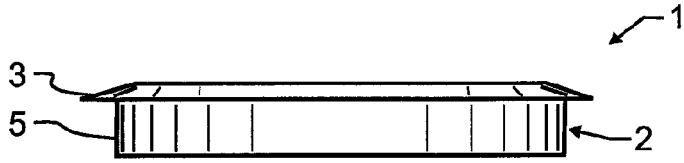
FIG. 5 illustrates the preferred embodiment garbage disposal blade guard of FIG. 1 from a side elevational view.

Manifested in the preferred embodiment, the present invention provides a novel garbage disposal blade guard that permits large waste to pass through, while preventing accidental passage of utensils and other undesirable objects. Further, the combination of guard and splash-back baffle cooperatively protects an operator from both harm and splash-back. In a preferred embodiment of the invention illustrated in FIGS. 1-5, a garbage disposal blade guard 1 is comprised of an outer ring 2, an inner ring 4, and radially extending bars 6. Inner ring 4 is connected to and supported from outer ring 2 by radially extending bars 6.

While garbage disposal blade guard 1 may be fabricated to meet various different sized drains, as will be understood by those reasonably skilled in the art, in one preferred embodiment outer ring 2 has sufficient diameter to fit within a school or commercial kitchen sink drain, and a sufficient depth to sit inside the throat of the drain. An exemplary garbage disposal and drain in co-operation with a similar guard is illustrated in my prior U.S. Pat. No. 7,740,197, entitled "Garbage disposal guard", the teachings and contents which were incorporated herein above by reference.

In the preferred embodiment, outer ring 2 and inner ring 4 are tubular, which means they may be designed to have minimal wall thickness for a minimum satisfactory strength to withstand operating forces applied thereto. The minimal wall thickness ensures a maximum open diameter. As a result, the use of this radial pattern of radially extending bars 6 in combination with inner ring 4 and outer ring 2 reduces the percentage of opening that is obstructed, thereby also improving the ease of passage of both water and waste through and into the garbage disposal. Inner ring 4 is designed and shaped generally circularly, to allow passage of relatively large food objects such as potatoes or partially eaten sandwiches, while limiting the size of other objects passing through the drain, thereby helping to prevent hands, dishes, silverware and cooking utensils from contacting the garbage disposal. Furthermore, by virtue of the round geometry of inner ring 4 and the radial arrangement of radially extending bars 6, larger sizes and quantities of food may pass through than prior art guards.

Outer ring 2 has a primary outer perimeter 5 that is designed to engage into the throat of the drain, or into the garbage disposal throat as may be appropriate. In order to assist with proper placement on installation and to prevent the preferred embodiment garbage disposal blade guard 1 from coming into contact with the garbage disposal grinding or cutting heads, outer ring 2 has a lip 3 of greater outer diameter than that of primary outer perimeter 5, preferably of such size to allow it to brace on the base of the sink. With appropriate dimensions of lip 3, the garbage disposal blade guard 1 can fit in drains within a range of dimensions. The smallest suitable size would be a pipe having an inside diameter approximately equal to the outer diameter of primary outer perimeter 5. The largest suitable inside diameter would be a pipe having an inside diameter just less than the outside diameter of lip 3.

Additional securement between guard 1 and a drain may preferably be obtained using one or more set screws 7 running radially through outer ring 2 and making contact with the throat of the drain, or may be obtained with other suitable fasteners as will be recognized and may be desired by those familiar with the art. For the purposes of the present disclosure, fasteners will be understood herein to include anything which fastens one object to another, and so is not limited to mechanical fasteners, and may, for exemplary purposes only and without limitation thereto, include adhesives or other bonding techniques. The use of set screws 7 permits the guard to be installed and removed at will, but not by someone without the proper tools to fit the set screw head geometry. As is known in the hardware art and incorporated herein, a wide variety of known head geometries are available. Consequently, an installer may determine what the preferred tool will be to fit set screw 7, and thereby determine how readily someone may access a tool.

Figure 6:
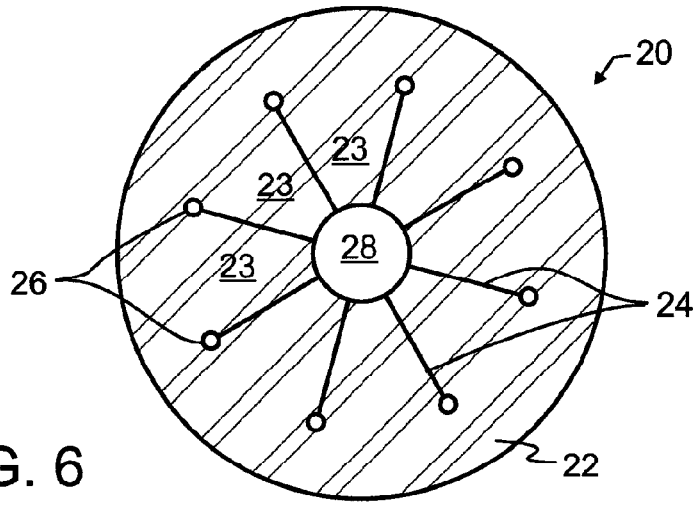
FIG. 6 illustrates a most preferred splash baffle for use in combination with the present invention.
Figure 7:
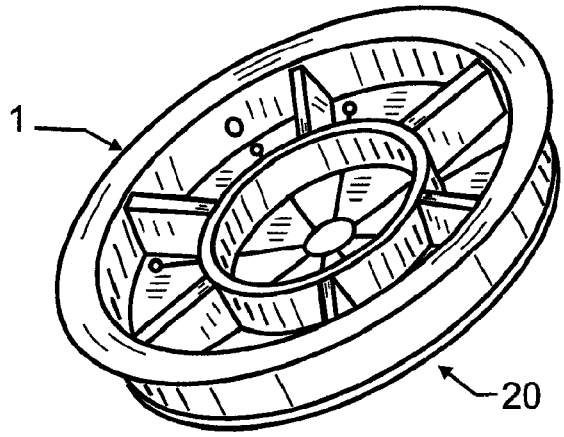
FIG. 7 illustrates a preferred combination of the splash baffle illustrated in FIG. 6 with garbage disposal blade guard of FIGS. 1-5 from a projected view.
Figure 8:
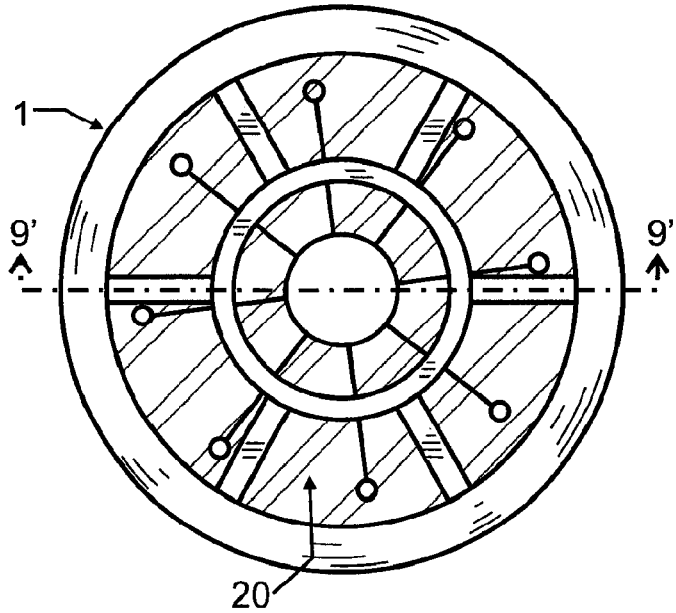
FIG. 8 illustrates the preferred combination splash baffle and garbage disposal blade guard of FIG. 7 from a top plan view.
Figure 9:
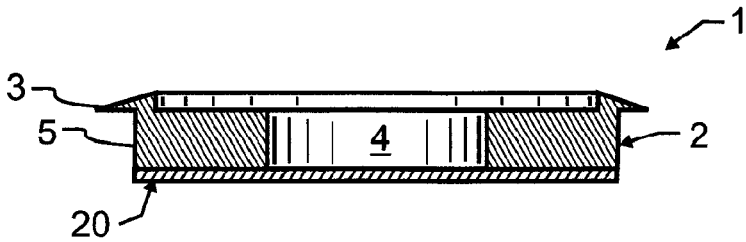
FIG. 9 illustrates the preferred combination splash baffle and garbage disposal blade guard of FIG. 7 from sectional view taken along line 9' of FIG. 8.
Figure 10:
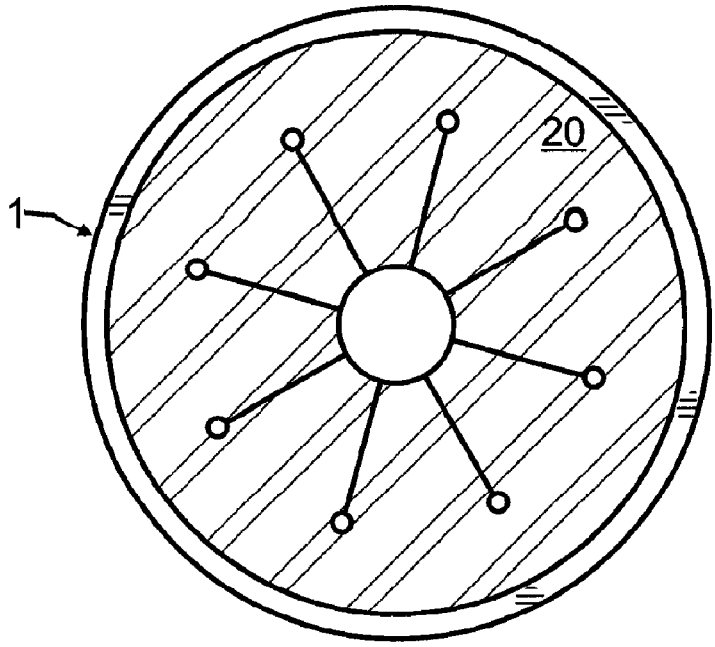
FIG. 10 illustrates the preferred combination splash baffle and garbage disposal blade guard of FIG. 7 from a bottom plan view.
Figure 11:
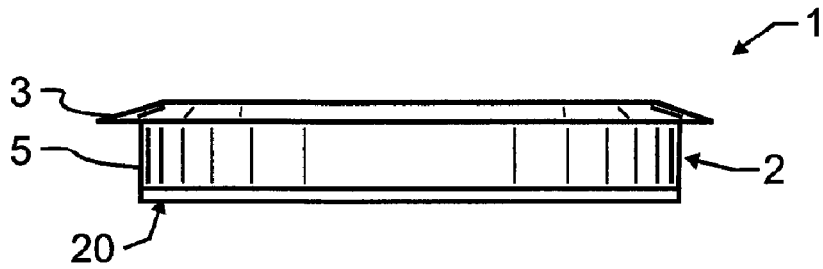
FIG. 11 illustrates the preferred combination splash baffle and garbage disposal blade guard of FIG. 7 from a side elevational view.

While garbage disposal blade guard 1 as illustrated in FIGS. 1-5 offers benefit over prior art disposal blade guards, garbage disposal blade guard 1 will permit back splash through the open regions between outer ring 2, inner ring 4 and radially extending bars 6. This may be preferred in some installations, particularly where a user is satisfied with the disposal, including any back splash baffles that may be provided therewith. However, to further enhance the performance of garbage disposal blade guard 1, splash baffle 20 as illustrated in FIG. 6 may be further combined therewith. Splash baffle 20 most preferably is fabricated from generally planar and resilient sheet stock such as a semi-rigid rubber or elastomeric material. This material defines a base 22. The sheet stock is preferably flexible enough when unsupported to allow food to readily pass through and yet resilient enough when even partially supported to prevent passage of unintended utensils or other objects, and to prevent back splash from coming up the drain throat.

In order to allow for passage of food, base 22 has flaps 23 radiating from the center of base 22. Flaps 23 are created by slits 24, which likewise radiate from the center of the base 22. During operation, wear and tear through use of splash baffle 20 and the associated flexure of flaps 23 could cause slits 24 to extend and rip base 22 apart over time. To help prevent this, the ends of slits 24 closest to the perimeter of base 22 are rounded off into circles 26. Furthermore, to ease the flow of materials through the splash baffle 20, there is a small cut-out 28 at the center of base 22.

Most preferably, splash baffle base 22 is of the same or similar diameter as outer ring 2, allowing base 22 to be anchored in place on the underside of the garbage disposal blade guard 1 as illustrated in FIGS. 7-11. Splash baffle 20 may be screwed into secure engagement with garbage disposal blade guard 1, or may alternatively be affixed with other suitable fasteners or using other suitable coupling. A benefit of screw engagement is the ability to remove and replace splash baffle 20, though there are many factors that will be considered in selecting the method and permanency of securement between splash baffle 20 and garbage disposal blade guard 1.

Once splash baffle 20 is coupled with garbage disposal blade guard 1, as illustrated in FIGS. 7-11, waste matter and water may readily deform flaps 23 downward towards the garbage disposal, to thereby slide through the unsupported splash baffle 20 and pass into the garbage disposal grinder or cutter heads. In the case of back splash, or objects being propelled off of the grinder or cutter blades, splash baffle 20 including flaps 23 will be deflected upwards and stopped in firm support against garbage disposal blade guard 1. In this way, flaps 23 and garbage disposal blade guard 1 act as a whole in a manner similar to a one-way valve, to permit passage of matter to the garbage disposal while preventing passage of matter from the disposal back into the sink. The proximity of inner ring 4 to the inner circumference of flaps 23 adds stiffness to flaps 23 when flaps 23 would otherwise deflect upwards. Furthermore, a designer may decide how many radially extending bars 6 and slits 24 to provide, and at what positions relative to each other, to optimize the design for a particular application. The unique combination of outer ring 2, inner ring 4, and radially extending bars 6 with splash baffle 20, and the placement of splash baffle 20 immediately adjacent to inner ring 4 and radially extending bars 6, allows a substantially larger percentage of garbage disposal blade guard 1 to be open, while still providing desired protection to an operator.

From the foregoing figures and description, several additional features and options become more apparent. First of all, garbage disposal blade guard 1 and splash baffle 20 may be manufactured from a variety of materials, including metals, resins and plastics, ceramics or cementitious materials, or even combinations, laminates or composites of the above. The specific material used may vary, though special benefits are attainable if several important factors are taken into consideration. First, splash baffle 20 will preferably act as a one-way valve for matter to pass into a garbage disposal. By using partially resilient or elastomeric materials, there is a dampening of energy in the event an object or matter is impelled out of the disposal. For splash baffle 20, a rubber material is preferred, but preferably of a type which provides dampening in combination with resilience. Furthermore, it is preferable that all materials are sufficiently tough and durable to not fracture, even when great forces are applied thereto. In the case of garbage disposal blade guard 1, a preferred material is Ultra-High Molecular Weight (UHMW) polyethylene, which has the advantages of being stain resistant, extremely tough and durable to withstand great force, scuff resistant, readily cleaned, and readily colored to yellow or other color signifying the safety function.

In addition, the exact geometry of inner ring 4 and radially extending bars 6 is not critical to the proper function and operation of the invention. For exemplary purposes, and not solely limiting thereto, radially extending bars 6 may be chamfered or rounded at their junctions with inner ring 4 and outer ring 2, which provides greater strength and a rounded intersection rather than sharp corner, such that, when desired, the intersections will be much easier to clean. Likewise, the top surfaces may be rounded. The numbers of radially extending bars, and even the angular displacement between each pair of adjacent bars, may be varied to suit differing needs and desires, including but not limited to such considerations as optimization of splash baffle support, and optimization of opening geometry for particular matter being passed through garbage disposal blade guard 1. Further, the geometry and materials of each individual component can deviate from the embodiments illustrated herein for other reasons, including artistic variations, without altering the scope of the invention. Finally, as is best visible in the sectional views of FIGS. 3 and 9, the elevation of radially extending bars 6 is slightly less than the adjacent lip 3. This provides a small indent into which a stop may be placed if desired, but there is no requirement that radially extending bars 6 be at any specific elevation.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. In combination, a garbage disposal blade guard and splash baffle for guarding a garbage disposal adjacent a plumbing inlet thereof from accidental and harmful interaction, said garbage disposal blade guard comprising:

an outer ring defining an exterior circumference approximately sized to coincide with an inside diameter of said plumbing inlet;

an inner ring defining an open and unobstructed inner circumference; and radial bars extending between said inner ring and said outer ring;

said splash baffle comprising an elastomeric sheet affixed adjacent to said garbage disposal blade guard, and having slits radiating from a center of said elastomeric sheet that divide said elastomeric sheet into a plurality of resilient flaps;

said splash baffle operative in combination with said garbage disposal blade guard to define a flexible one-way valve permitting matter to pass into said garbage disposal while substantially blocking matter from being ejected from said garbage disposal through said garbage disposal blade guard.

2. The garbage disposal blade guard and splash baffle of claim 1, further comprising open circles terminating said slits adjacent to said outer ring.

3. The garbage disposal blade guard and splash baffle of claim 1, wherein said splash baffle further comprises a small opening at the center of said elastomeric sheet.

4. The garbage disposal blade guard and splash baffle of claim 3, wherein, in the event matter is ejected from said garbage disposal into said splash baffle, said inner ring supports said resilient flaps between said splash baffle small center opening and an outer perimeter of said splash baffle.

5. The garbage disposal blade guard and splash baffle of claim 1, further comprising a fastener securing said outer ring to said plumbing inlet.

6. The garbage disposal blade guard and splash baffle of claim 1, wherein said garbage disposal blade guard further comprises a lip having an outer perimeter of diameter greater than said inside diameter of said plumbing inlet, said lip terminating said outer ring distal to said garbage disposal, whereby small variances of diameter in said plumbing inlet are accommodated by said lip so that said lip will rest upon said plumbing inlet and support said garbage disposal blade guard therefrom.

7. The garbage disposal blade guard and splash baffle of claim 1, further comprising a removable fastener coupling said garbage disposal blade guard to said splash baffle, whereby said removable fastener may be removed to permit said garbage disposal blade guard to be non-destructively separated from said splash baffle, and said splash baffle to thereby be replaced.

8. The garbage disposal blade guard and splash baffle of claim 1, wherein said inner ring is tubular and said outer ring is tubular.

9. In combination, a garbage disposal blade guard and splash baffle for guarding a garbage disposal adjacent a plumbing inlet thereof from accidental and harmful interaction, said garbage disposal blade guard comprising:

an outer ring defining an exterior circumference approximately sized to coincide with an inside diameter of said plumbing inlet; and an inner ring coupled with said outer ring and defining an open and unobstructed inner circumference;

said splash baffle comprising a resilient body affixed adjacent to said garbage disposal blade guard and extending generally across said plumbing inlet and constricting flow therethrough and having at least one resilient flap;

said resilient flap operative in combination with said garbage disposal blade guard when pressed towards said garbage disposal to flex away from said garbage disposal blade guard and thereby facilitate the passage of matter into a garbage disposal, and operative in combination with said garbage disposal blade guard when pressed away from said garbage disposal by matter ejected from said garbage disposal to flex towards said garbage disposal blade guard and be constrained against further flexure by said garbage disposal blade guard when said resilient flap is in a generally closed position, thereby substantially blocking matter from being ejected from said garbage disposal through said garbage disposal blade guard.

10. The garbage disposal blade guard and splash baffle of claim 9, wherein said garbage disposal blade guard further comprises a plurality of radial bars extending between said inner ring and said outer ring.

11. The garbage disposal blade guard and splash baffle of claim 9, wherein said splash baffle further comprises an elastomeric body divided into a plurality of resilient flaps.

12. The garbage disposal blade guard and splash baffle of claim 11, wherein said splash baffle further comprises a small opening at the center of said elastomeric body.

13. The garbage disposal blade guard and splash baffle of claim 12, wherein said splash baffle has a plurality of slits that separate adjacent ones of said plurality of resilient flaps, and further comprising open circles terminating said slits adjacent to said outer ring.

14. The garbage disposal blade guard and splash baffle of claim 12, wherein, in the event matter is ejected from said garbage disposal into said splash baffle, said inner ring supports said resilient flaps between said splash baffle small center opening and an outer perimeter of said splash baffle.

15. The garbage disposal blade guard and splash baffle of claim 9, further comprising a removable fastener coupling said garbage disposal blade guard to said splash baffle, whereby said removable fastener may be removed to permit said garbage disposal blade guard to be non-destructively separated from said splash baffle, and said splash baffle to thereby be replaced.

* * * * *